US006477872B1

(12) United States Patent
Denton, Jr.

(10) Patent No.: US 6,477,872 B1
(45) Date of Patent: Nov. 12, 2002

(54) LOCKING MECHANISM FOR STORAGE UNITS

(75) Inventor: James R. Denton, Jr., San Antonio, TX (US)

(73) Assignee: Hendry Investments, Inc., San Antonio, TX (US)

( * ) Notice: Subject to any disclaimer, the term of this patent is extended or adjusted under 35 U.S.C. 154(b) by 0 days.

(21) Appl. No.: 09/941,271

(22) Filed: Aug. 28, 2001

(51) Int. Cl.[7] ..... E05B 65/06

(52) U.S. Cl. ..... 70/129; 70/80; 70/99; 70/100; 70/DIG. 11

(58) Field of Search ..... 70/129, 13, 32–34, 70/80, 81, 79, 78, 96, 99, 100, DIG. 11, 139

(56) References Cited

U.S. PATENT DOCUMENTS 2,677,261 A * 5/1954 Jacobi ..... 70/14
3,412,586 A * 11/1968 Sterner ..... 70/92
3,820,283 A * 6/1974 Accera et al. ..... 49/449
4,570,467 A * 2/1986 Grecco ..... 70/99
4,751,831 A * 6/1988 Morris, Jr. et al. ..... 70/159
4,751,834 A * 6/1988 Beck ..... 70/452
4,938,041 A * 7/1990 O'Gara ..... 70/95
5,404,734 A * 4/1995 Martinez ..... 70/34
5,444,998 A * 8/1995 James
5,819,561 A * 10/1998 Blehi, III ..... 70/14
5,931,032 A * 8/1999 Gregory ..... 70/129
5,946,952 A * 9/1999 Mintchenko ..... 70/2

* cited by examiner

*Primary Examiner*—Anthony Knight
*Assistant Examiner*—John B Walsh
(74) *Attorney, Agent, or Firm*—Michelle Evans; Gunn, Lee & Hanor, P.C.

(57) ABSTRACT

A storage unit door locking system is shown for securing and locking a storage unit door and preventing forced entry wherein the door is attached to a doorjamb. The locking system has a door plate which is mounted to the door with an extension plate that extends beyond the edge of the door and abuts the front face of the doorjamb when the door is closed. A sliding bolt slidably mounted to, but spaced apart from, the door plate slides behind the doorjamb trapping the doorjambs between the extension plate and the sliding bolt. A recessed lock is inserted through matching aligned holes in the extension plate, doorjamb, and sliding bolt and locked. This physically locks the doorjamb to the extension plate and sliding bolt which prevents forced entry with the use of crowbars or other prying devices normally used to separate the doorjamb from the door and locks contained thereon.

8 Claims, 4 Drawing Sheets

LOCKING MECHANISM FOR STORAGE UNITS

BACKGROUND OF THE INVENTION

1. Field of the Invention

The present invention relates generally to a locking system and more particularly to a locking system for storage unit doors.

2. Background Information

The use of walk-in storage units for storing household, office, and other items has increased dramatically in recent years. Unfortunately, there has also been a dramatic increase in theft of items from storage units which results in a need for more effective locking systems for the storage units.

Exterior walls of a typical storage unit are made of corrugated sheet metal. The storage unit doors are typically either horizontally swinging or roll-up type doors also made of corrugated sheet metal. Framing the door entrance is a sheet metal doorjamb.

Traditionally, the storage unit door is closed with a sliding bolt mechanism which can include a lock. The locking mechanism is secured to the door and has a member extending beyond the vertical edge of the door which abuts the doorjamb when the door is closed. The bolt mechanism slides behind the doorjamb to trap the doorjamb between the bolt and the extending member to prevent the door from swinging open. Traditionally, these sliding bolts were locked and held in place by means of a padlock. However, thieves easily overcome these locks by simply cutting the padlocks with bolt cutters when no one is around.

In an attempt to solve this problem, the sliding bolt mechanisms were designed with a recessed lock as shown in FIGS. 1 and 2. The recessed lock inserts through a hole in the door plate and a matching, aligned hole in the bolt when the bolt is slid into a locking position. When the recessed lock is inserted through the holes and turned with a key, it is locked in position and holds the bolt in the locking position. Once again, thieves are able to overcome this locking mechanism by prying the doorjamb with a crowbar or other prying device thereby allowing the bolt and door to swing free. It is desirable to have a slide-bolt locking mechanism with a key activated recess lock for a storage unit door which cannot be overcome by prying the doorjamb with a prying device to free the bolt and open the door.

SUMMARY OF THE INVENTION

It is an object of this invention to provide an improved storage unit door locking system to prevent forced entry.

It is a further object of this invention to provide a locking system for a storage unit door which utilizes a recessed locking device.

It is a further object of this invention to provide a locking system for a storage unit door which utilizes a sliding bolt for ease of operation.

It is a further object of this invention to provide a locking system for a storage unit door which prevents forced entry by the use of a prying device to pry the doorjamb to free the locking bolt.

It is a further object of this invention to provide a locking system for a storage unit door which secures the locking bolt to the doorjamb.

In order to achieve these objectives, this invention provides for a locking mechanism which is comprised of a door plate which is affixed to the storage unit door. The door plate is equipped with an extension plate which extends beyond the vertical edge of the storage unit door such that when the door is closed, the extension plate abuts the doorjamb and is flush against the doorjamb. The door plate is further equipped with a sliding bolt behind the door plate which slides behind the doorjamb and traps the doorjamb between the extension plate and sliding bolt.

A recessed lock is used to lock and hold the sliding bolt into place. The recessed lock slides into matching, aligned holes in the extension plate, doorjamb and the sliding bolt. When the recessed lock is inserted into the holes and the key is turned and removed, the recessed lock is locked in place and further locks the sliding bolt and extension plate in place. Since the doorjamb is physically locked to the steel extension plate and steel sliding bolt, it cannot be pried open with the use of a crowbar.

DETAILED DESCRIPTION OF THE PREFERRED EMBODIMENT

Figure 1:
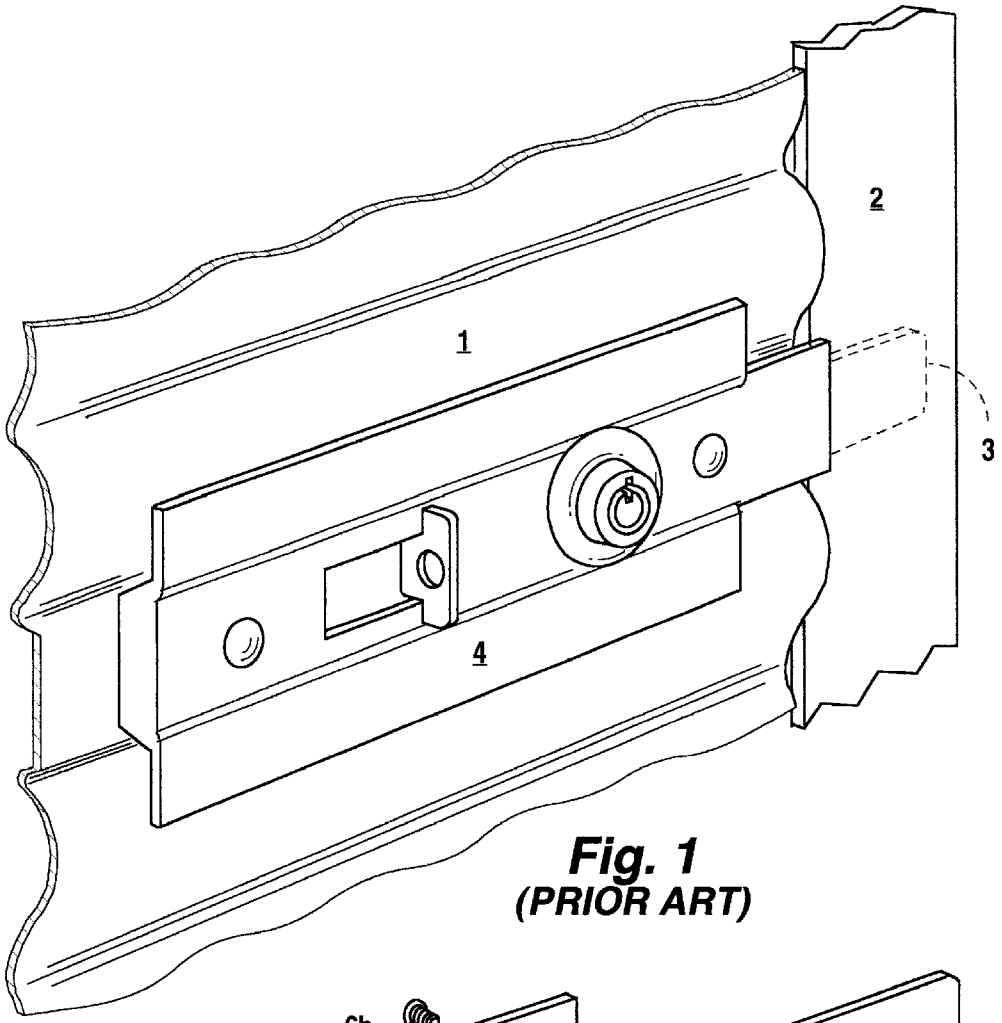
Fig. 1 (PRIOR ART)
FIG. 1 is a perspective view depicting the prior art mechanism with a recessed lock.
Figure 2:
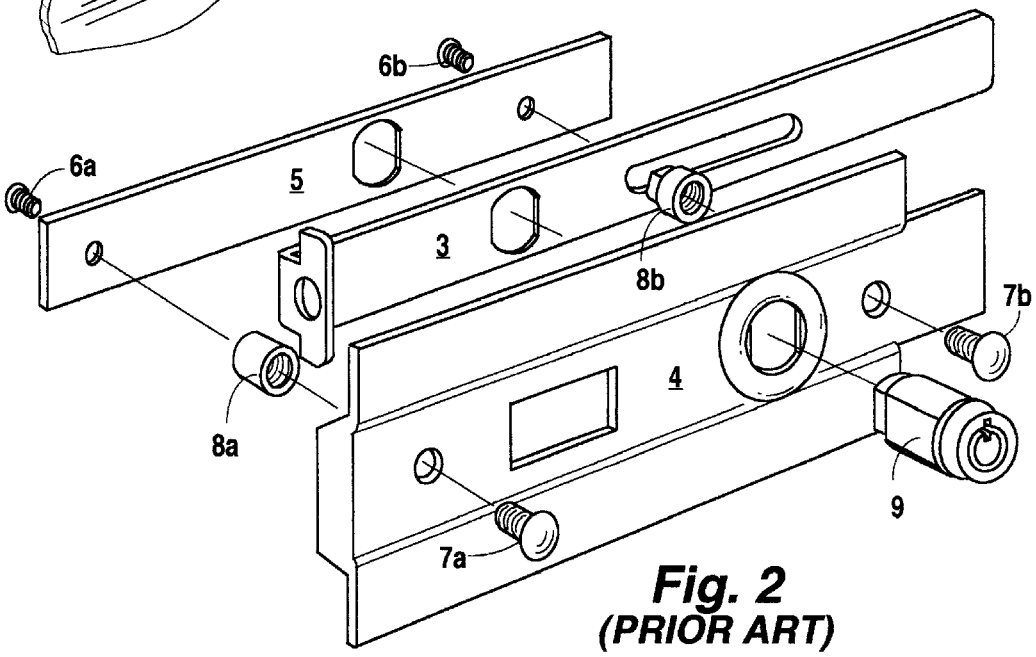
Fig. 2 (PRIOR ART)
FIG. 2 is an exploded perspective view depicting the same prior art mechanism shown in FIG. 1.

In the prior art shown in FIGS. 1 and 2, a door 1 locks into a doorjamb 2 by a sliding bolt 3 that extends into an opening (not shown) in the doorjamb 2. The sliding bolt 3 is slidably attached to the door 1 by a door plate 4 which is secured to the door 1 by back plate 5 and held together by bolts 6*a*, 6*b*, 7*a* and 7*b* threadably connecting into spacers 8*a* and 8*b*, respectively. The spacers 8*a* and 8*b* provide the separation space needed for movement of the sliding bolt 3. Back plate 5 is inside the door 1 and door plate 4 is outside the door 1. A recessed lock 9 by extending through aligned holes locks the sliding bolt 3 in the extended position. However, when the door 1 is locked and the sliding bolt 3 locked into its extended position in the doorjamb 2, the door 1 and doorjamb 2 may be easily pried apart by a crowbar or similar prying device.

Figure 3:
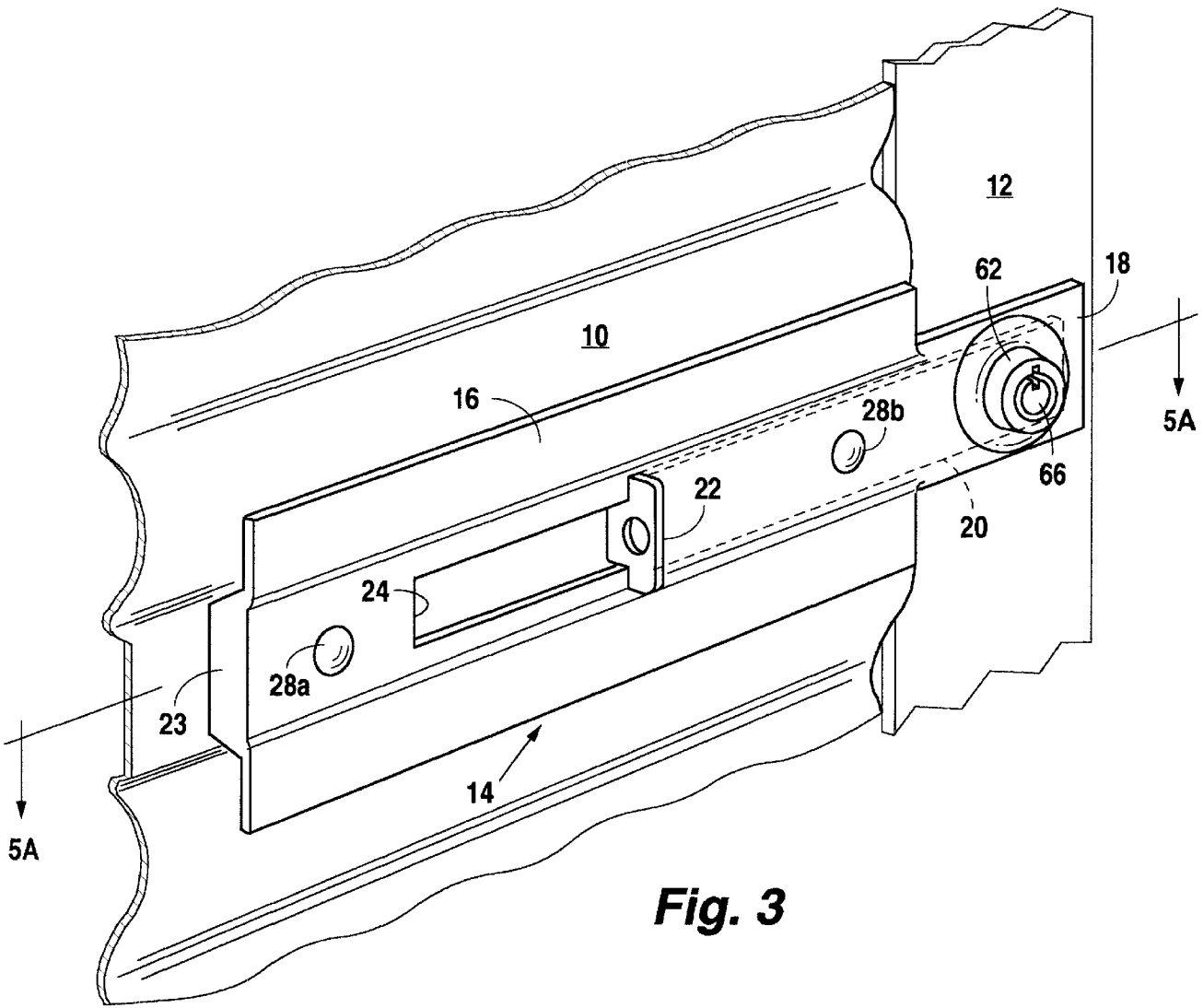
FIG. 3 is a perspective view of a locking mechanism mounted to the storage unit door and set in the locked position.
Figure 4:
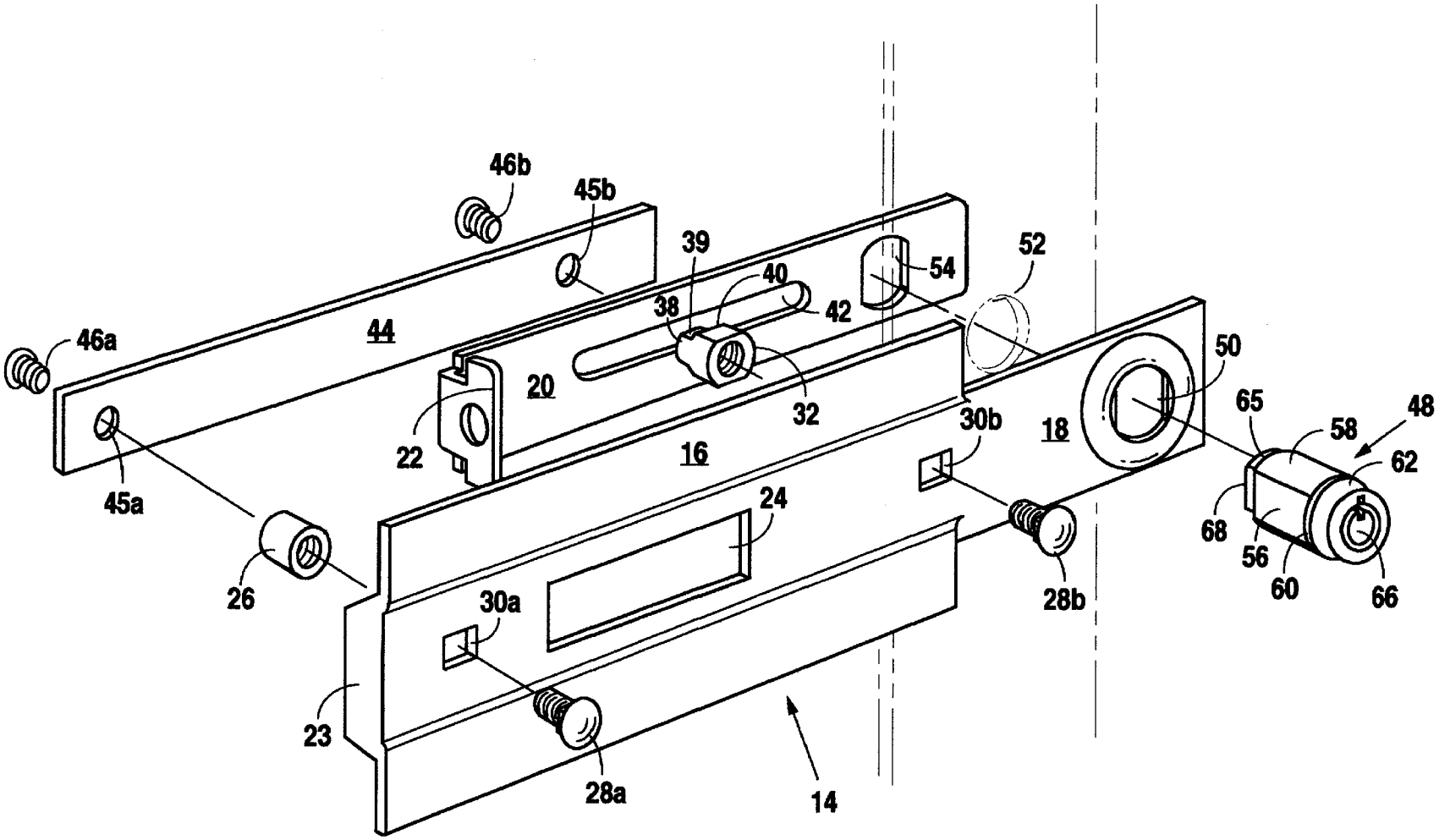
FIG. 4 is an exploded perspective view of the locking mechanism shown in FIG. 3.

Referring to FIGS. 3 and 4, a storage unit door 10 made of corrugated metal is shown in a closed position such that the right vertical edge of the storage unit door 10 is adjacent a doorjamb 12. A locking mechanism 14 is mounted to the storage unit door 10. The locking mechanism 14 is equipped with a door plate 16, an extension plate 18, a bolt 20, a bolt handle 22, a protecting flange 23, an outer spacer 26, an inner spacer 32, and a mounting plate 44. In the preferred embodiment, each of the component parts of the locking mechanism is made of steel.

The outer spacer 26 and inner spacer 32 are interiorly threaded through their depth and mounted to the back surface of the door plate 16 by means of a stove pipe screws 28*a* and 28*b* passing through square holes 30*a* and 30*b* centered vertically in the door plate 16. In the preferred embodiment, the outer spacer 26 is circular and the inner spacer 32 is oval with a horizontal major diameter. The depth of the outer spacer 26 and inner spacer 32 are equal and sufficient to allow the door plate 16 to mount between corrugations in the storage unit door 10 with the outer spacer 26 and inner spacer 32 filling the gap between the storage unit door 10 and the door plate 16 at its vertical center. Horizontal flat surfaces 39 are cut into opposite sides of a rear portion 38 of the inner spacer 32 creating shoulder 40 (See FIG. 4).

The locking mechanism 14 is mounted to the storage unit door 10 with a mounting plate 44 which mounts to the back surface of the storage unit door 10 by means of two screws 46*a* and 46*b* passing through aligned holes 45*a* and 45*b* in the mounting plate 44 and the storage unit door 10 and screwing into the backs of the outer spacer 26 and the inner spacer 32. In the preferred embodiment of the invention, the mounting plate 44 is a horizontally elongated rectangular plate and serves a dual purpose. First, it is used to brace and secure the locking mechanism 14 to the storage unit door 10. Second, it prevents would-be thieves from prying the screws 46*a* and 46*b* through the storage unit door 10 and dismantling the locking mechanism 14.

The bolt 20 is positioned to slide between the storage unit door and the door plate 16. The bolt 20 has a horizontal elongated opening 42. The vertical width of this opening 42 is sufficient to allow the bolt 20 to fit over the rear portion 38 of the inner spacer 32 with minimal clearance and slide on the flat surfaces 39 of the inner spacer 32. The horizontal length of the opening 42 is sufficient to allow the bolt 20 to slide on the rear portion 38 of the inner spacer 32 from a locked position, as shown in FIGS. 3 and 4, to an unlocked position as shown in FIG. 5*b*.

The bolt 20 is equipped with a bolt handle 22 which extends perpendicularly from the end of the bolt 20 opposite the doorjamb 12. The bolt handle 22 extends through and slides within a rectangular opening 24 in the door plate 16. The rectangular opening 24 is positioned on the door plate 16 and has a horizontal length sufficient to allow the bolt 20 to move from the unlocked position into the locked position.

The locking mechanism 14 is positioned on the storage unit door 10 so that when the storage unit door 10 is closed, the back surface of the extension plate 18 abuts and rests flush against the doorjamb 12 (see FIG. 3). While the locking mechanism 14 is in this position, the bolt 20 can be slid horizontally on the flat surfaces 39 of the rear portion 38 of the inner spacer 32 until the bolt 20 extends into the locking position behind the doorjamb 12. The shoulder 40 acts as a stop and prevents the bolt 20 from moving towards the door plate 16 while the bolt 20 is being slid horizontally and insures that the bolt 20 will slide behind the doorjamb 12 (see FIGS. 5A and 5B.

Figure 5A:
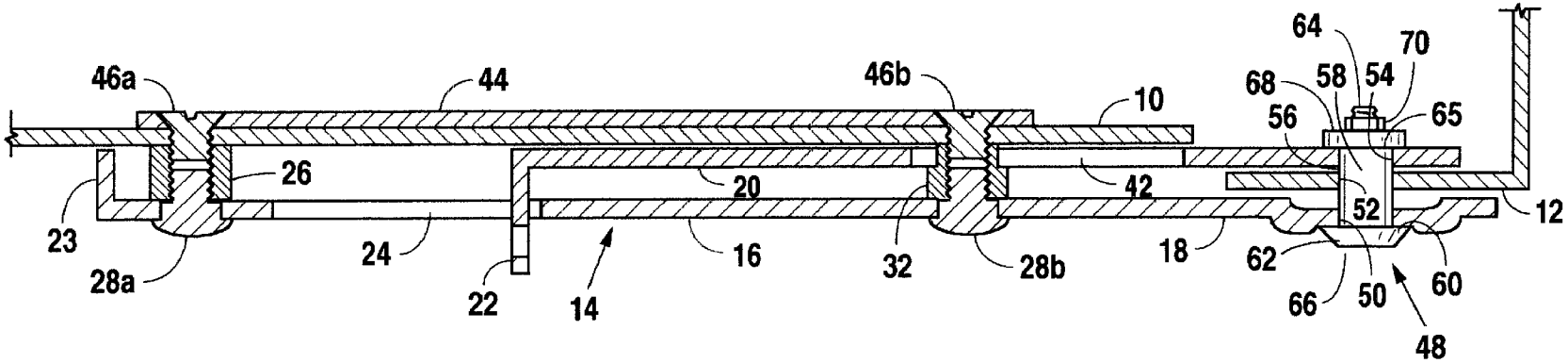
FIG. 5A is a cross sectional view taken along line 5—5 of FIG. 3 while the mechanism is in a locked position.
Figure 5B:
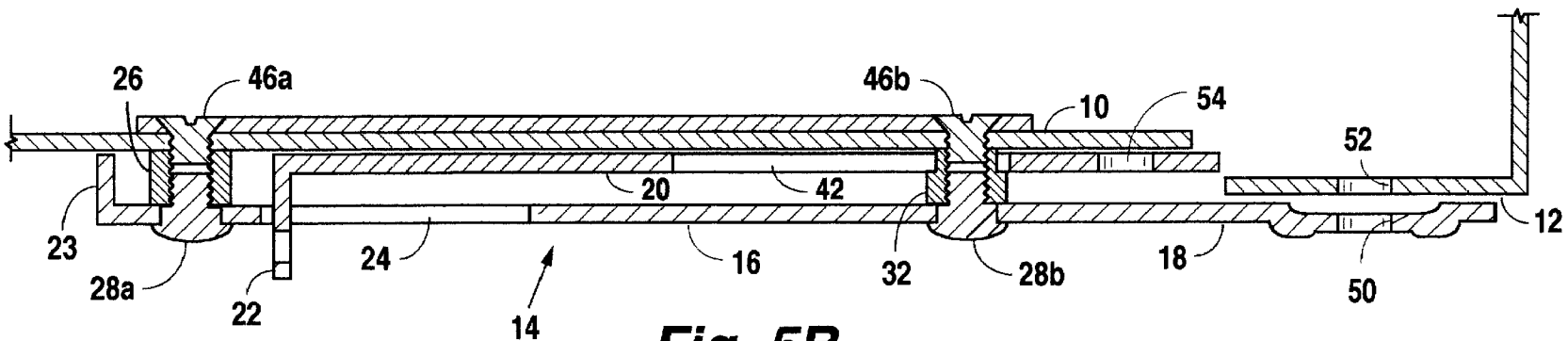
FIG. 5B is a cross sectional view taken along line 5—5 of FIG. 3 while the mechanism is in an unlocked position.

When the bolt 20 is slid into the locked position behind the doorjamb 12 to lock the storage unit door 10 in place, a recessed lock 48 is inserted and extends through an opening 50 in the extension plate 18, an opening 52 in the doorjamb 12, and an opening 54 in the bolt 20 (see FIGS. 4, 5A and 5B). The recessed lock 48 is cylindrical with vertical flat surfaces 56 cut into opposite sides of a rear portion 58 of the recessed lock 18 creating a shoulder 60 toward the front end 62 of the recessed lock 48 (see FIG. 4). The shoulder 60 acts as a stop and abuts the front surface of the extension plate 18 when the recessed lock 48 is fully inserted. To frustrate tampering, the peripheral of the front end 62 of the recessed lock 48 is frustroconical in shape and terminates near the shoulder 60. In one preferred embodiment of this invention, the recessed lock 48 is manufactured by L.A.I., model number KM4540. However, it is anticipated that other conventional recessed locks could perform adequately in this invention.

An exteriorly threaded shaft 64 extends perpendicularly from the rear vertical surface 65 of the recessed locked 48. The shaft 64 rotates as the activating key (not shown) is inserted in the front face 66 of the recessed lock 48 and turned. The rotating shaft 64 extends through a circular opening (not shown) in a rotating plate 68 which is secured to the rotating shaft 64 with a nut 70 (see FIGS. 4 and 5A). The front face of the rotating plate 68 abuts a shoulder (not shown) on the rotating shaft 64 which extends from the rear face 65 of the recessed lock 48 a sufficient distance to allow the rotating plate 68 to rotate with minimal clearance. The rotating plate 68 can be rotated 90 degrees from a unlocked position to a locked position. The size and shape of the rotating plate 68 is such that when it is in the unlocked position, its outer edges do not extend beyond the outer edges of the rear face 65 of the recessed lock 48, and when the rotating plate 68 is rotated 90 degrees to the locked position, the outer edges of the rotating plate 68 extend horizontally beyond the outer edges rear face 65 of the recessed lock 48.

The shapes of the opening 50 in the extension plate 18 and the opening 54 in the bolt 20 are the same, circular with flat vertical sides. The major and minor diameters of the opening 50 and the opening 54 are sufficient to allow the rear portion 58 of the recessed lock 48 to pass through with minimal clearance. The flat sides of the opening 52 and the opening 54 engage the flat surfaces 56 of the rear portion 58 of the recessed lock 48 and prevent rotation of the recessed lock 48 with respect to the extension plate 18 and bolt 20.

When the recessed lock 48 is fully inserted such that the shoulder 60 abuts the front face of the extension plate 18, the depth of the rear portion 58 of the recessed lock 48 is sufficient to allow the rear portion 58 of the recessed lock 48 to pass through the openings 50, 52, and 54 such that the outer edge of the rear face 65 of the recessed lock 48 extends beyond the rear face of the bolt 20 with minimal clearance. If the activation key (not shown) is then inserted into the face 66 of the recessed lock 48 and turned 90 degrees, it will cause the rotating shaft 64 to turn, rotating the rotating plate 68 approximately 90 degrees. In this rotated position, the outer edges of the rotating plate 68 extend horizontally beyond the outer edges of the rear face 65 of the recessed lock 48 a sufficient distance to provide an interference with the back surface of the bolt 20 and thereby preventing removal of the recessed lock 48 (see FIG. 5A). In this manner, the extension plate 18, doorjamb 12, and bolt 20 are physically locked together. This prevents a prying device, such as a crowbar, from separating the doorjamb 12 from the locking mechanism 14 as was possible in the prior art.

A protecting flange 23 extends perpendicularly toward the storage unit door 12 from the end of the door plate 16 opposite the extension plate 18. The protecting flange 23 is centered vertically on the door plate 16 and has a height and width sufficient to cover the gap created between the door plate 16 and the corrugations in the door 10 and prevent the insertion of prying devices or other tools of forced entry between the door plate 16 and the storage unit door 10.

Although the invention has been described with specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A locking system for securing a door to a doorjamb to prevent forced entry by a prying device, said locking system comprising:

a door plate affixed to said door, said door plate having an extension member which extends beyond said vertical edge of said door and abuts said doorjamb, said extension member having an extension member opening positioned in front of said doorjamb and aligned with an opening in said doorjamb;

a slide member slidably connected to said door plate, said slide member positioned to slide into a locking position behind said doorjamb, said slide member having a slide member hole which aligns with said extension member opening and said opening in said doorjamb when said slide member is extended into said locking position;

a locking member extending through said extension member opening, said opening in said doorjamb, and said slide member hole, said locking member being rotatable to secure said extension member, said doorjamb, and said slide member together to prevent prying apart; and a mounting plate inside said door and securely mounted to said door plate, said door plate being outside said door.

2. The locking system for securing a door to a doorjamb to prevent forced entry by a prying device of claim 1 further comprising first and second spacers between said door and said door plate.

3. The locking system for securing a door to a doorjamb to prevent forced entry by a prying device of claim 2 wherein said first and second spacers are interiorly threaded, said first and second spacers being secured to said door plate by means of screws.

4. A locking system for securing a door to a doorjamb to prevent forced entry by a prying device, said locking system comprising:

a door plate affixed to said door, said door plate having an extension member which extends beyond said vertical edge of said door and abuts said doorjamb, said extension member having an extension member opening positioned in front of said doorjamb and aligned with an opening in said doorjamb;

a slide member slidably connected to said door plate, said slide member positioned to slide into a locking position behind said doorjamb, said slide member having a slide member hole which aligns with said extension member opening and said opening in said doorjamb when said slide member is extended into said locking position, wherein said slide member has a handle portion extending perpendicularly from said slide member through a rectangularly elongate hole in said door plate, said rectangularly elongated hole positioned in said door plate to allow said handle portion of said slide member to slide within the rectangularly elongated opening and moving said slide member in and out of a locked position; and a locking member extending through said extension member opening, said opening in said doorjamb, and said slide member hole, said locking member being rotatable to secure said extension member, said doorjamb, and said slide member together to prevent prying apart.

5. A method of locking a door to a doorjamb to prevent forced entry by a prying device consisting of the following steps:

locating a mounting plate inside said door and adjacent to an edge thereof;

affixing a door plate to said mounting plate, said door plate being outside said door and a distal end extending beyond said edge thereof to abut said doorjamb;

spacing said door plate away from said door to define a slide space therebetween;

positioning a slide bar in said slide space so that an outer end thereof extends behind at least a portion of said doorjamb that abuts said distal end;

inserting a removable lock through said distal end of said door plate, said portion of said doorjamb, and said outer end of said slide bar; and locking said removable lock to prevent removal of said removable lock thereby grabbing said portion of said doorjamb to further prevent said prying device from opening said door.

6. The method of locking a door to a doorjamb to prevent forced entry by a prying device as recited in claim 5 includes providing holes in said distal end of said door plate, said portion of said doorjamb, and said outer end of said slide bar to receive said removable lock therein.

7. The method of locking a door to a doorjamb to prevent forced entry by a prying device as recited in claim 6 wherein said spacing step includes having headless screws outside said door connecting through said door plate, spacers and said door to said mounting plate, said spacing step and said affixing step being performed simultaneously.

8. The method of locking a door to a doorjamb to prevent forced entry by a prying device as recited in claim 5 includes the step of sliding said slide bar (a) into a locking position prior to said inserting step or (b) into an opening position prior to opening said door.

* * * * *